US005778715A

United States Patent [19]

Lippka et al.

[11] Patent Number: 5,778,715

[45] Date of Patent: Jul. 14, 1998

[54] COLD ROLLING POSITIONING ROLLER ASSEMBLY

[75] Inventors: Sandra M. Lippka, Warwick, R.I.; James O. Williams, Marlboro, Mass.

[73] Assignee: Grinnell Corporation, Cranston, R.I.

[21] Appl. No.: 744,106

[22] Filed: Nov. 5, 1996

[51] Int. Cl.[6] ..... B21D 17/04

[52] U.S. Cl. ..... 72/106

[58] Field of Search ..... 72/101, 105, 106, 72/110

[56] References Cited

U.S. PATENT DOCUMENTS

| | | | |
|---|---|---|---|
| 1,284,093 | 11/1918 | Grotnes | 72/106 |
| 1,463,073 | 7/1923 | Felten | 72/106 |
| 1,541,601 | 6/1925 | Tribe . | |
| 2,267,533 | 12/1941 | O'Brien | 285/129 |
| 2,617,466 | 11/1952 | Kradoska | 72/101 |
| 2,689,752 | 9/1954 | Webster | 285/94 |
| 3,191,416 | 6/1965 | Pritchett | 72/106 |
| 3,290,914 | 12/1966 | Vaill et al. | 72/117 |
| 3,995,466 | 12/1976 | Kunsman | 72/105 |
| 4,408,788 | 10/1983 | Beukema | 285/419 |
| 5,279,143 | 1/1994 | Dole | 72/105 |
| 5,450,738 | 9/1995 | Chatterley et al. | 72/106 |

FOREIGN PATENT DOCUMENTS

| | | | |
|---|---|---|---|
| 535059 | 10/1931 | Germany | 72/105 |
| 57-94423 | 6/1982 | Japan | 72/106 |
| 18201 | 6/1916 | United Kingdom | 72/105 |

OTHER PUBLICATIONS

"Ridge Tool Subsidiary Emerson Electric Co.", Model 9181-1 Roll Grooving Machine Literature, (Rigid Tool Company, 1996).

"The Fastest Roll Grooving Machine in its Class?", Distributor New Product Update, (Ridge Tool Company Information Line Addendum . . . Jun. 1996).

"Mechanical Piping Systems", (Victaulic), 4 pages.

"Pipe Preparation Tools", (Vitaulic), 3 pages.

"Pace Pipe Processing Equipment", (Pace Machinery Group, Inc.), 3 pages.

"Gruvlok Copper Method", (Grinnell Supply Sales Company, Mar. 1994), 3 pages.

"Gruvlok Copper–Prep", Model 1041C Roll Groover Operating Instructions, (Grinnell Supply Sales Company), 2 pages.

"The Copper Connection" (Victaulic, May 1990), 12 pages.

"AWWA Standard for Grooved and Shouldered Joints" (American Water Works Association, May 1987), 10 pages.

"Expanded Pipe Coupling Style 24" (Victaulic, 1985), 4 pages.

"GRUVLOK® Products for Grooved Piping Systems" (Grinnell Corporation, Sep. 1991), 60 pages.

"GRUVLOK® Pipe Machines" (Grinnell Corporation, Feb. 1992), 16 pages.

*Primary Examiner*—Lowell A. Larson
*Attorney, Agent, or Firm*—Fish & Richardson P.C.

[57] ABSTRACT

A positioning roller assembly for use when cold rolling a tube includes first and second positioning rollers disposed for initial contact with a tube surface, and a mechanism for maintaining contact of the first and second positioning rollers relative to the tube surface during groove rolling. The first positioning roller is positioned to apply a first initial predetermined load to the tube and the second positioning roller is positioned to apply a second, smaller initial predetermined load to the tube. The mechanism acts on the tube in a manner to equalize the loads to offset the tube during cold rolling. The positioning rollers also apply a downward load to the tube during cold rolling to, e.g., reduce tube end flaring when cold rolling a groove in a steel pipe and stabilize a cold rolling machine when cold rolling outward steps in a copper pipe.

19 Claims, 7 Drawing Sheets

COLD ROLLING POSITIONING ROLLER ASSEMBLY

BACKGROUND OF THE INVENTION

This invention relates to positioning roller assemblies for cold rolling tubes.

During cold rolling, the tube must be offset angularly from the centerline of grooving roller contact so that the tube continuously feeds itself into the grooving machine. It has been known to use a guide roller positioned to the side of the tube to offset the tube so that the user does not have to try to hold the tube in position while the tube is being cold rolled.

When cold rolling a groove in a tube, the end of the tube being cold rolled has a tendency to flair. Flaring occurs when the opposite end of the tube angles upward from horizontal. When cold rolling longer tubes, e.g., longer than about 1 to 2 feet, flaring is minimized because the weight of the tube itself prevents it from angling upward.

SUMMARY OF THE INVENTION

According to one aspect of the invention, a positioning roller assembly for use when cold rolling a tube includes first and second positioning rollers disposed for initial contact with a tube surface, and a mechanism for maintaining contact of the first and second positioning rollers relative to the tube surface during cold rolling.

Preferred embodiments of the invention may include one or more of the following additional features. The mechanism comprises a spring formed from a stack of belleville washers or a coiled helical spring. The positioning rollers are mounted to a face plate which is mounted for movement with an outside groove roll. The mechanism is adapted to move the face plate relative to the outside groove roll during cold rolling.

The first positioning roller is positioned to apply a first initial predetermined load to the tube and the second positioning roller is positioned to apply a second, smaller initial predetermined load to the tube. The mechanism acts on the tube in a manner to equalize the loads to offset the tube during cold rolling. The positioning rollers are positioned to apply a downward load to the tube during cold rolling.

The positioning roller assembly includes an adjuster, e.g., an adjustment rod, for adjusting the position of the positioning rollers prior to cold rolling. The adjustment rod is mounted for rotation and sliding movement relative to a carrier assembly to which an outside groove roll is fixedly mounted; the adjustment rod includes a threaded section. The positioning rollers are mounted to a face plate including a mating section defining a threaded hole for cooperative engagement with the rod threaded section, whereby rotation of the rod causes movement of the face plate relative to the carrier assembly for fine adjustment of the positioning rollers prior to cold rolling. The spring is mounted to the rod and constrained between a shelf of the rod and the carrier assembly, whereby forces applied to the positioning rollers during cold rolling act to compress the spring. The roller assembly includes a frame. The carrier assembly is a pivot assembly mounted to pivot relative to the frame, or a slide assembly mounted to slide relative to the frame.

A rod is mounted to the carrier assembly to which the outside groove roll is fixedly mounted and the positioning rollers are mounted to a face plate including the mating section; the spring is mounted to the rod and constrained between the mating section and the carrier assembly whereby motion of the positioning rollers act upon the spring.

According to another aspect of the invention, a cold rolling machine for cold rolling a tube includes an outside groove roll, an inside groove roll, and a positioning roller assembly. The positioning roller assembly includes first and second positioning rollers disposed for initial contact with a tube surface; a face plate for mounting of the positioning rollers, the face plate being mounted for movement with the outside groove roll; and a mechanism for positioning of the positioning rollers during cold rolling, the mechanism providing for movement of the face plate relative to the outside groove roll during cold rolling.

According to another aspect of the invention, a method of cold rolling a tube comprises the steps of a) providing a cold rolling apparatus including an outside groove roll, an inside groove roll, and a positioning roller assembly; b) positioning an end of a tube to be cold rolled between the outside and inside groove rolls; c) moving the outside groove roll and the positioning rollers into contact with an outside surface of the tube such that the tube is held between the outside groove roll and the inside groove roll; and d) further moving the outside groove roll toward the inside groove roll to cold roll the tube while the mechanism maintains contact of the positioning rollers with the tube during cold rolling.

Advantages of the invention include positioning rollers which cause the tube to be offset during groove rolling and which also apply a downward load to the tube. Offsetting the tube enables self-feeding of the tube into the groove rolls. The downward load reduces tube end flaring when cold rolling a groove in a steel pipe, particular useful in tubes shorter than about 1 foot long, and acts to stabilize a cold rolling machine when cold rolling outward steps in a copper pipe. The positioning rollers provide for hands-off cold rolling of tubing.

DESCRIPTION OF THE PREFERRED EMBODIMENTS

Figure 1:
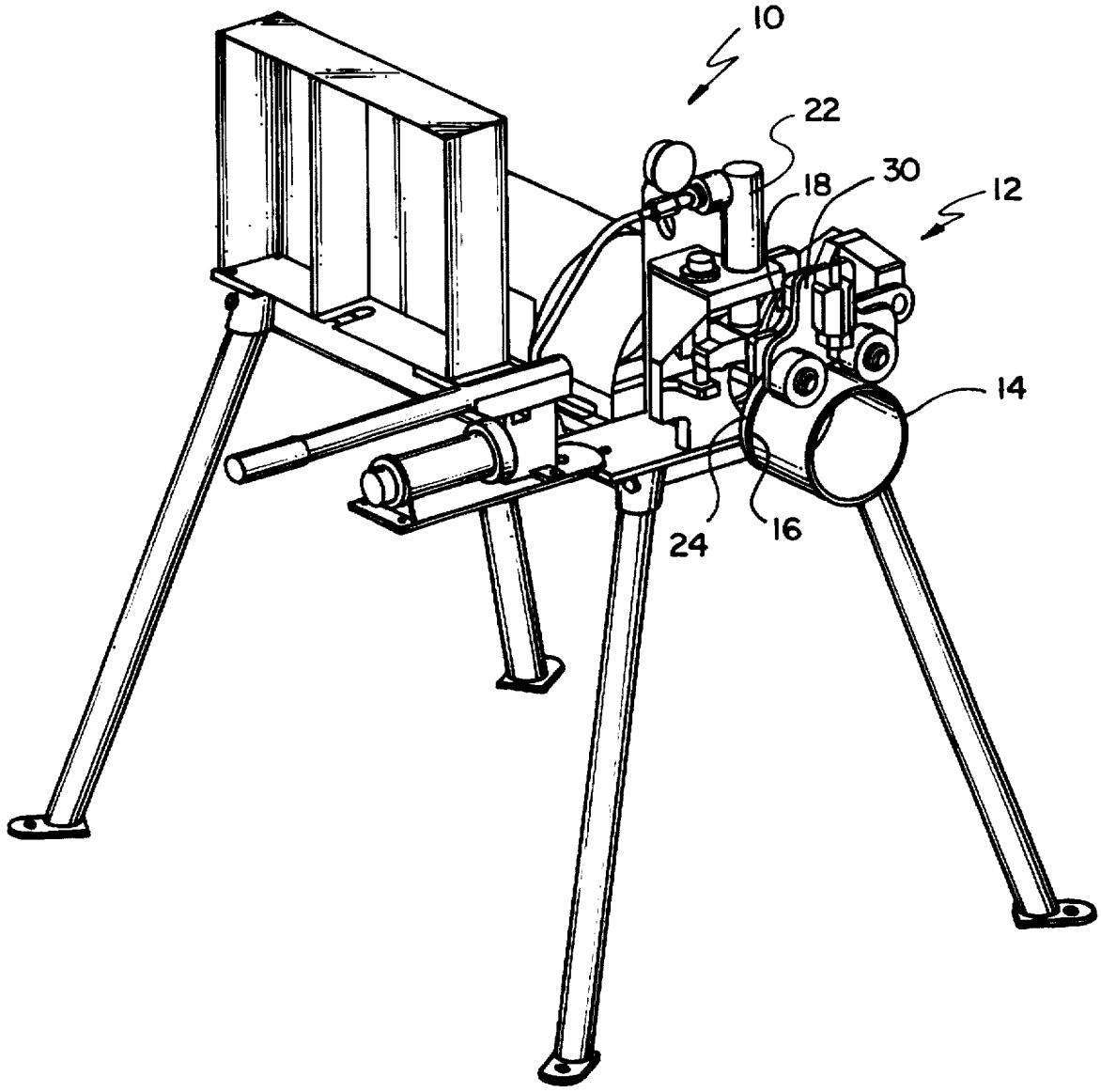
FIG. 1 is a diagrammatic representation of a cold rolling machine.

Referring to FIG. 1, a cold rolling machine 10 includes a rolling assembly 12 for positioning a tube 14 for and during cold rolling of the tube 14. Rolling assembly 12 includes an outside groove roll 18 and an inside groove roll 20 (see FIG. 3). A hydraulic ram 22 lowers outside groove roll 18 to act against inside groove roll 20. A positioning roller assembly 30 is mounted for movement with outside groove roll 18. Positioning roller assembly 30 enables hands-off feeding of the tube into the groove rolls.

Figure 2:
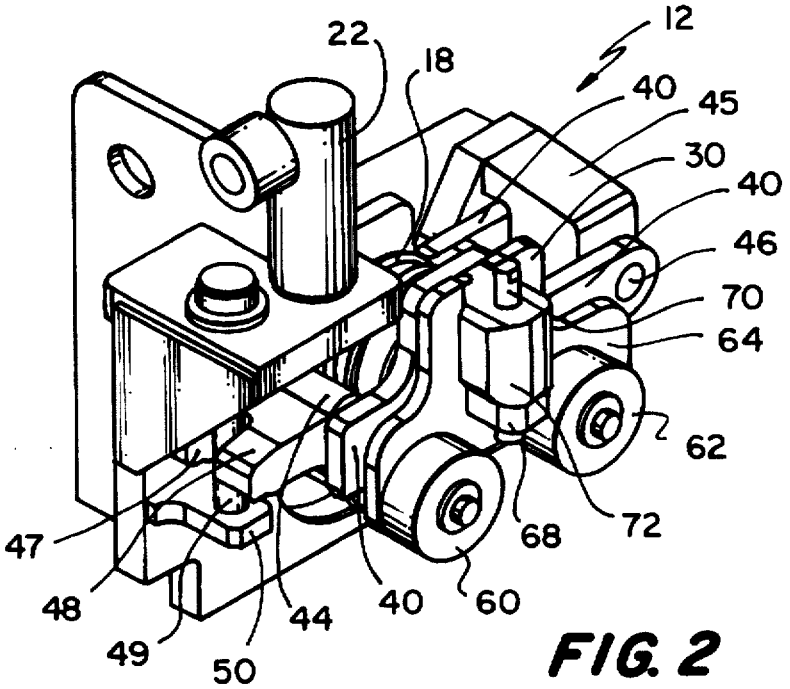
FIG. 2 shows a rolling assembly of the cold rolling machine of FIG. 1.
Figure 3:
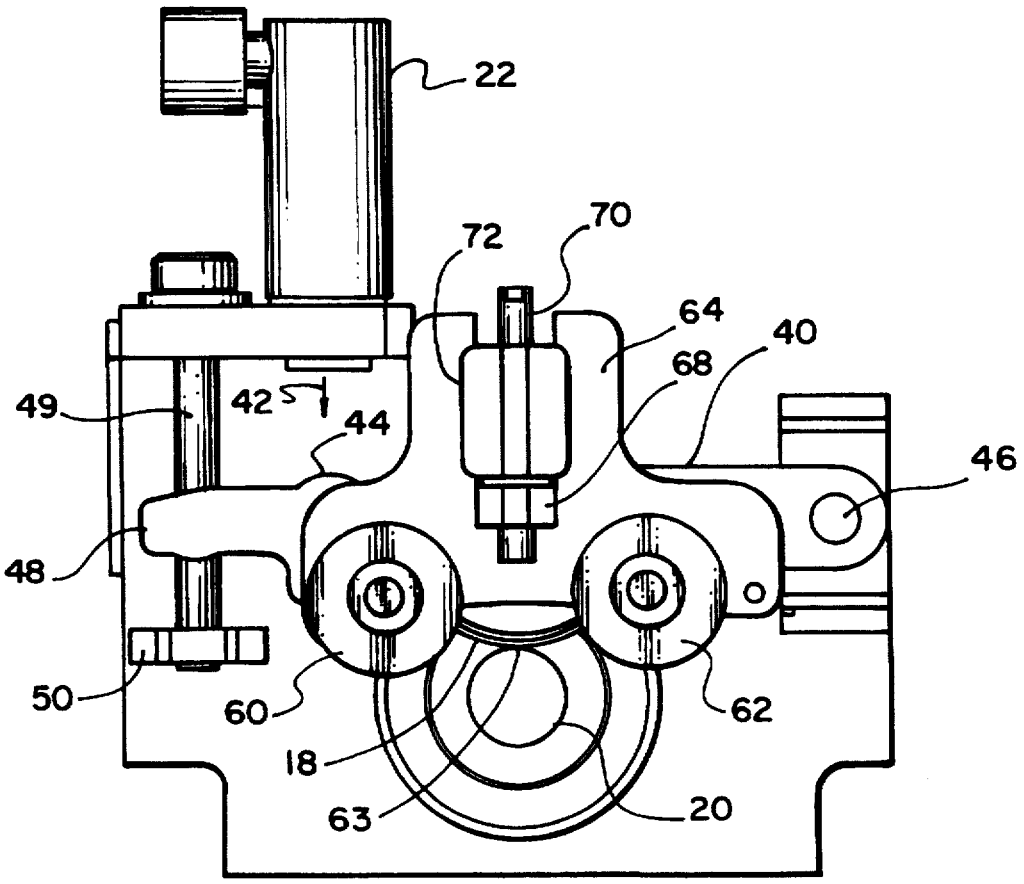
FIG. 3 is a side view of the rolling assembly of FIG. 2.

Referring to FIGS. 2 and 3, rolling assembly 12 includes a pivot arm 40 to which outside groove roll 18 is rotatably mounted. Hydraulic ram 22 is lowered (arrow 42) to contact a surface 44 of pivot arm 40 to lower outside groove roll 18 and positioning roller assembly 30 by pivoting motion of pivot arm 40 relative to a rolling assembly frame 45 about a pivot point 46. Pivot arm 40 includes an extension 48 with a notched section 47 which runs along a threaded guide rod 49. A depth stop 50 threadedly connected to guide rod 49 limits the depth to which pivot arm 40 can be lowered. The position of depth stop 50 is adjusted by rotation of guide rod 49.

Positioning roller assembly 30, which is particularly suited for producing a groove in a short length of tubing, e.g., steel piping having a length as short as about 4.5 inches and a diameter in the range of about 2–12 inches, includes first and second positioning rollers 60, 62. When pivot arm 40 is lowered, roller 62 contacts tube 14 followed by roller 60 contacting the tube. This produces a greater force between roller 62 and the tube than between roller 60 and the tube. During cold rolling, the differential load causes tube 14 to reposition to equalize the loads, this offsets tube 14 from a line of contact 63 between outside and inside rollers 18, 20, e.g., by about ¼ degree. The offset prevents tube 14 from feeding itself out of the cold rolling machine 10. The rollers 60, 62 also provide a downward load on tube 14, explained further below, which positions tube 14 at a downward angle from line of contact 63 of, e.g., about ¼ degree, to reduce flaring of the tube end 24 during grooving (see FIG. 1). This combination of the tube being offset and the downward load on the tube enables hands-off feeding of the tube into the groove rolls 18, 20.

Figure 4:
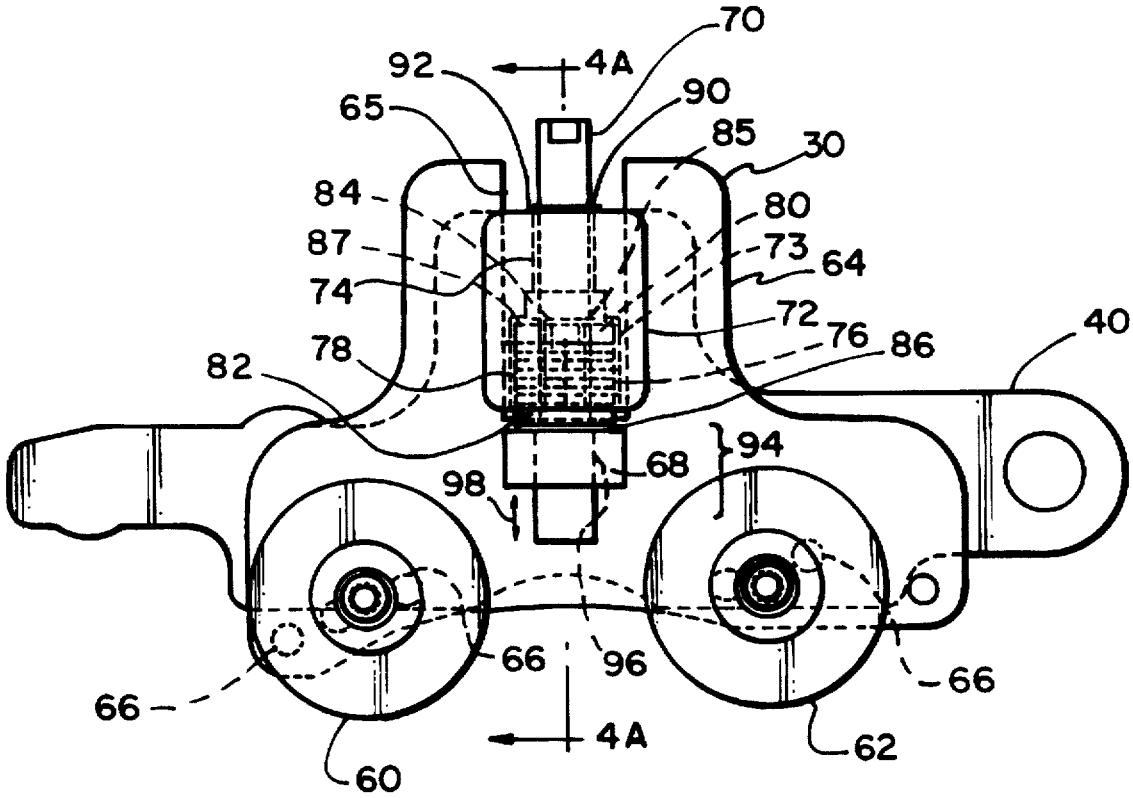
FIG. 4 is a side view of a positioning roller assembly and pivot arm of the rolling assembly of FIG. 2.
Figure 4A:
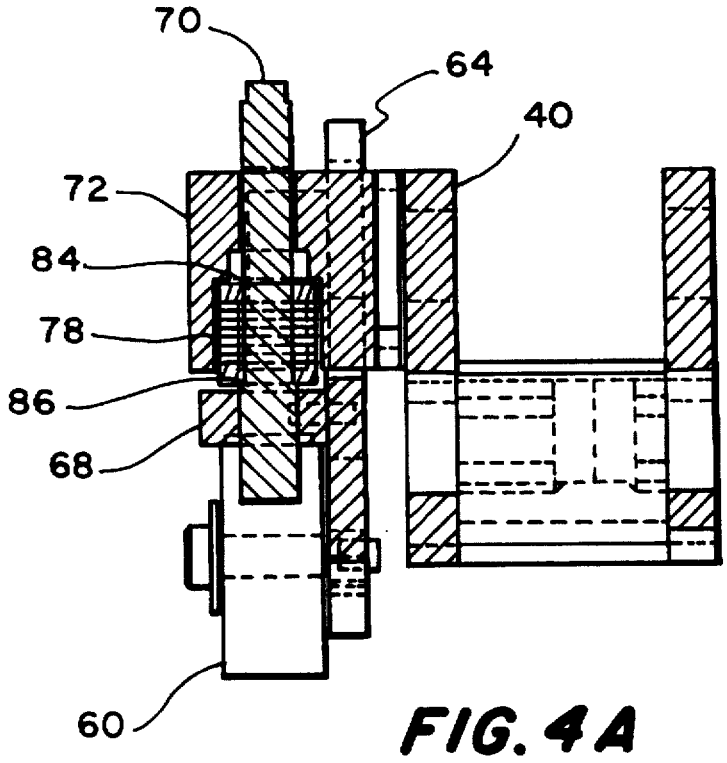
FIG. 4A is a cut-away view taken along lines 4A—4A of FIG. 4.

Referring to FIGS. 4 and 4A, first and second positioning rollers 60, 62 are rotatably mounted to a face plate 64 which includes mounting holes 66 permitting adjustment of the positions of positioning rollers 60, 62. Integral with face plate 64 is a mating section 68 which rotatably receives an adjustment rod 70. Face plate 64 and pivot arm 40 are connected by the mounting of adjustment rod 70 within a guide block 72 integral with pivot arm 40. Face plate 64 defines a slot 65 through which guide block 72 passes.

Adjustment rod 70 includes a snap ring groove 90 containing a snap-ring 92 for positioning adjustment rod 70 relative to guide block 72 (and hence pivot arm 40). Mating section 68 includes a threaded section 96 for receiving a cooperating threaded section 94 of adjustment rod 70. Rotation of adjustment rod 70 causes mating section 68 (and hence face plate 64 and rollers 60, 62) to move relative to pivot arm 40 along arrow 98 with slot 65 accommodating the relative motion between face plate 64 and guide block 72. Movement (along arrow 98) provides fine adjustment of positioning rollers 60, 62 relative to tube 14 after initial placement using ram 22. The fine adjustment gives the user precise control over the differential load between the two positioning rollers 60, 62 and tube 14, which determines the final offset of the tube, and over the downward load on the tube 14, which acts to reduce flaring of tube end 24.

Figure 5:
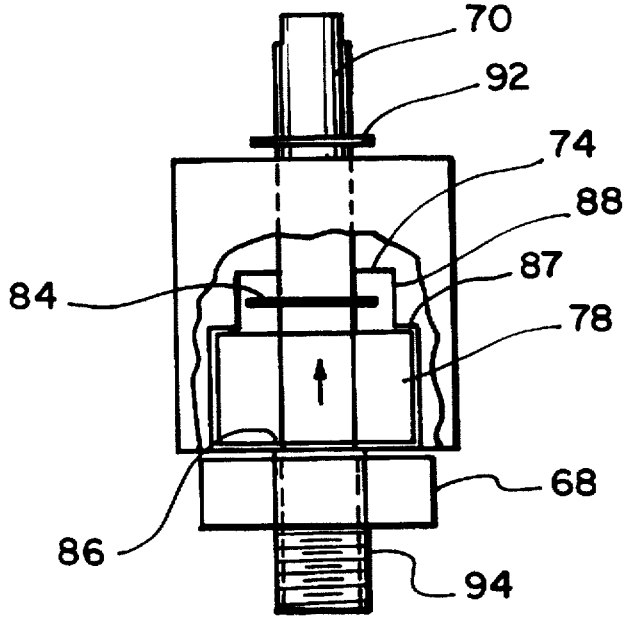
FIG. 5 shows compression of a spring of the positioning roller assembly of FIG. 4.

Located within an enlarged section 73 of a through bore 74 in guide block 72 are a series of belleville washers 76 forming a spring 78. Belleville washers 76 are located between a pair of end washers 80, 82. The end washers are constrained between a snap ring 84 and a shelf 86 defined by rod 70. Snap ring 84 is located in a snap ring groove 85 of rod 70. Referring to FIG. 5, upward movement of mating section 68 causes rod 70 to move upward, compressing spring 78 between shelf 86 and a ledge 87 defined by a smaller diameter section 88 of through bore 74. Section 88 accommodates travel of snap-ring 84 as mating section 68 and rod 70 travel upward.

To mount face plate 64 to guide block 72, spring 78 is first placed on rod 70 and snap ring 84 is placed in groove 85. Rod 70 is then passed into through bore 74 from below and snap ring 92 is placed in groove 90. Face plate 64 is aligned with guide block 72 in slot 65, and rod 70 is rotated to thread mating section 68 onto rod 70.

Figure 6:
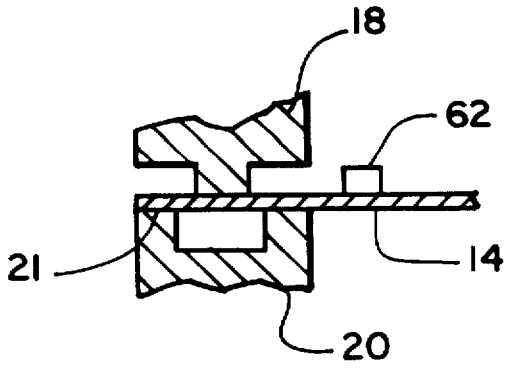
FIG. 6 is a cut-away view of a tube in an initial cold rolling position for producing a groove in the tube.
Figure 6A:
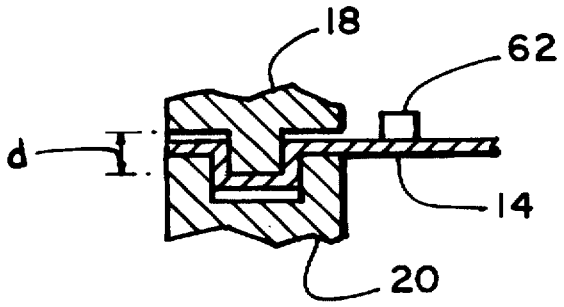
FIG. 6A shows the tube of FIG. 6 during cold rolling.

Referring to FIGS. 6 and 6A, in use for forming a groove in tube 14, the positions of outside roller 18 and positioning rollers 60, 62 are initially set using ram 22. Fine adjustment of the positioning rollers is then accomplished by turning adjustment rod 70 to place a desired side load and downward load on tube 14. The desired loads are determined experimentally, with too small a load allowing undesired flaring of tube end 24 and too large a load slowing the grooving process.

Groove rolling is begun by further lowering outside roller 18 using ram 22. It is desirable that while outside roller 18 lowers, positioning rollers 60, 62 (while applying a downward load on tube 14 to reduce flaring of tube end 14) remain substantially stationary, thereby reducing the tendency of tube 14 to be bent at a downward angle by undesirable downward motion of the rollers. Spring 78 allows relative motion between outside roller 18 and positioning rollers 60, 62. As outside roller 18 lowers by the depth, d, of the groove, spring 78 is compressed, resulting in rollers 60, 62 remaining substantially stationary. If positioning rollers 60, 62 where permitted to lower with outside groove roll 18, too high a load would be placed on tube 14 by the positioning rollers producing undesirable bending of the tube. To further prevent tube bending, inside groove roll 20 defines a seating region 21 which prevents tube end 24 from angling downward during groove rolling. A short length of tubing can thus be cold rolled in a hands-off process with the tube remaining substantially straight.

Figure 7:
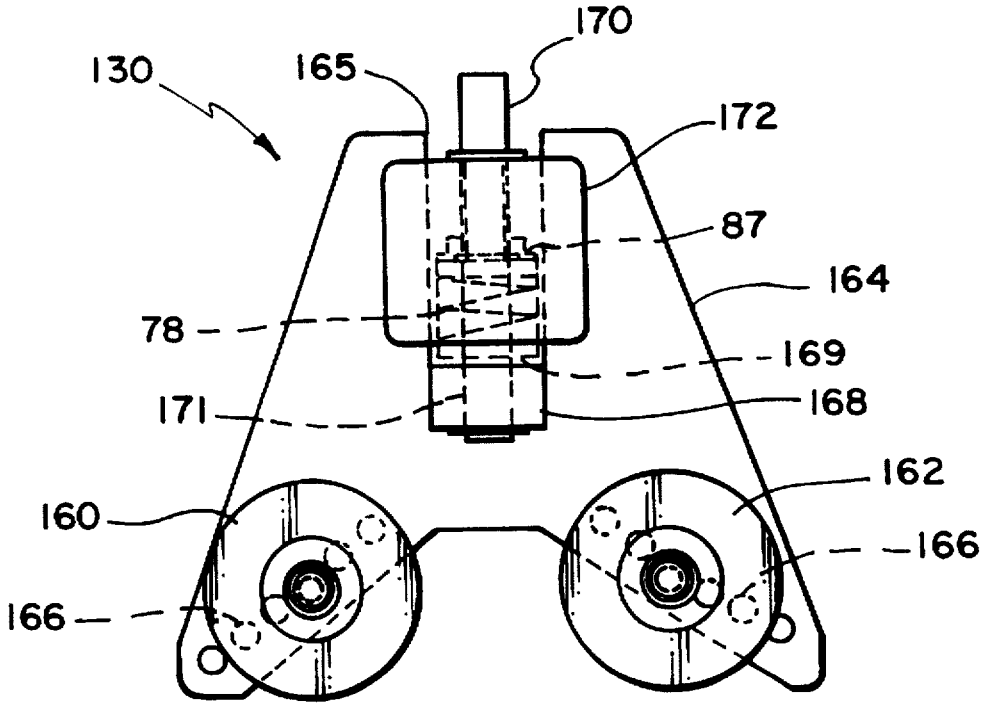
FIG. 7 is an additional embodiment of a positioning roller assembly for creating outward steps in a tube.
Figure 8:
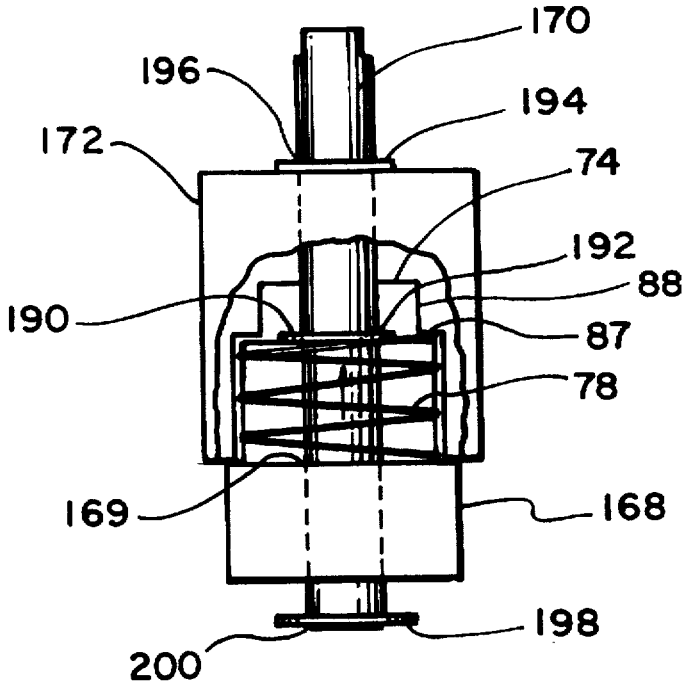
FIG. 8 shows the compression of a spring of the positioning roller assembly of FIG. 7.

Referring to FIGS. 7 and 8, a positioning roller assembly 130 for use with groove rolling device 10 for producing an outward step in a copper tube is shown. Apparatus for producing outward steps in copper tubing to which positioning roller assembly 130 can be adapted, are described in commonly owned, co-pending application U.S. Ser. No. 08/385,768, now U.S. Pat. No. 5,570,603, hereby incorporated by reference. Positioning roller assembly 130 includes a face plate 164 with a mating section 168 having a through bore 171 which slidably receives a rod 170. Face plate 164 defines holes 166 for receiving rollers 160, 162. Spring 78, e.g., a coiled helical spring, is constrained between ledge 87 of through bore 74 and an upper surface 169 of mating section 168. Upward movement of mating section 168 compresses spring 78 between upper surface 169 and ledge 87. Mating section 168 slides relative to rod 170 during upward movement of the mating section.

To mount face plate 164 to guide block 172, spring 78 is first placed on rod 170 and a snap ring 190 is placed in a groove 192 in rod 170. Rod 170 is passed into through bore 74 from below. A snap ring 194 is then placed in a groove 196 in rod 170, and face plate 164 is aligned with guide block 172 in slot 165 and rod 170 passing through bore 171 in mating section 168. A snap ring 198 is then placed in a groove 200 in rod 170.

Figure 9:
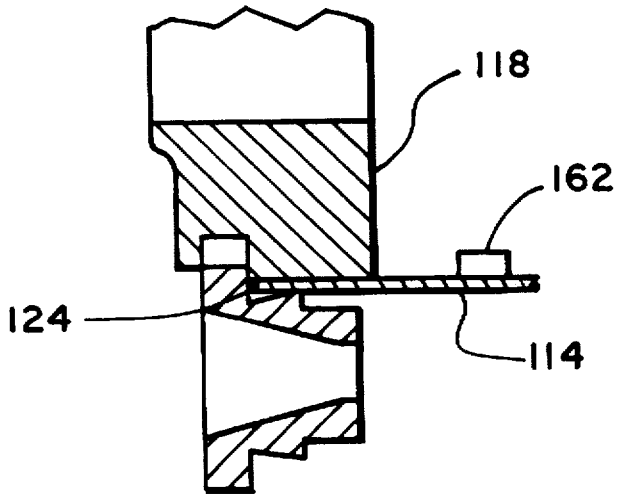
FIG. 9 is a cut-away view of a tube in an initial cold rolling position using the positioning roller assembly of FIG. 7.
Figure 9A:
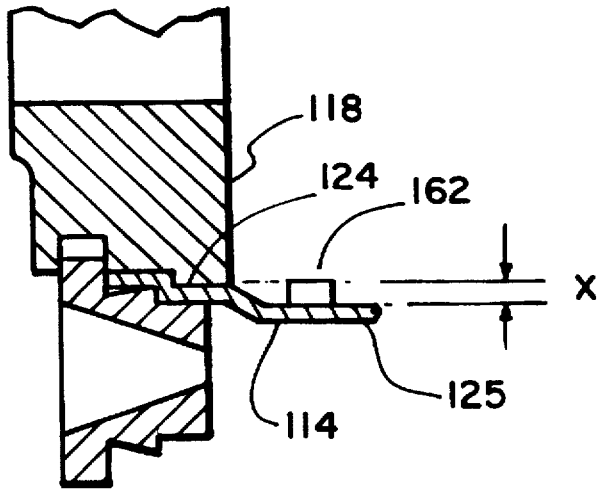
FIG. 9A shows the tube of FIG. 9 during cold rolling.

Referring to FIGS. 9 and 9A, in use for forming outward steps in a copper tube 114, the initial position (FIG. 9) of outside roller 118 and positioning rollers 160, 162 are set using ram 22. Outside roller 118 is preferably mounted, e.g., on a spherical plain bearing, to pivot as described in commonly owned, co-pending application U.S. Ser. No. 08/385,768, incorporated by reference supra. Spring 78 is preloaded in this position such that spring 78 can expand by a distance, X, during cold rolling to maintain contact of rollers 160, 162 with tube 114. The position of rollers 160, 162 in holes 166 is selected to set the desired offset of the tube for self-feeding into the groove rolls and to set the preload on spring 78. Outside roller 118 and rollers 160, 162 are lowered using ram 22 to cold roll tube 114. As tube end 124 is expanded, the main portion 125 of tube 114 lowers and spring 78 expands to accommodate this extra movement such that rollers 160, 162 remain in contact with the tube. This continuous contact during the cold rolling process stabilizes cold rolling machine 10 preventing dangerous wobbling and banging of tube 14.

Figure 10:
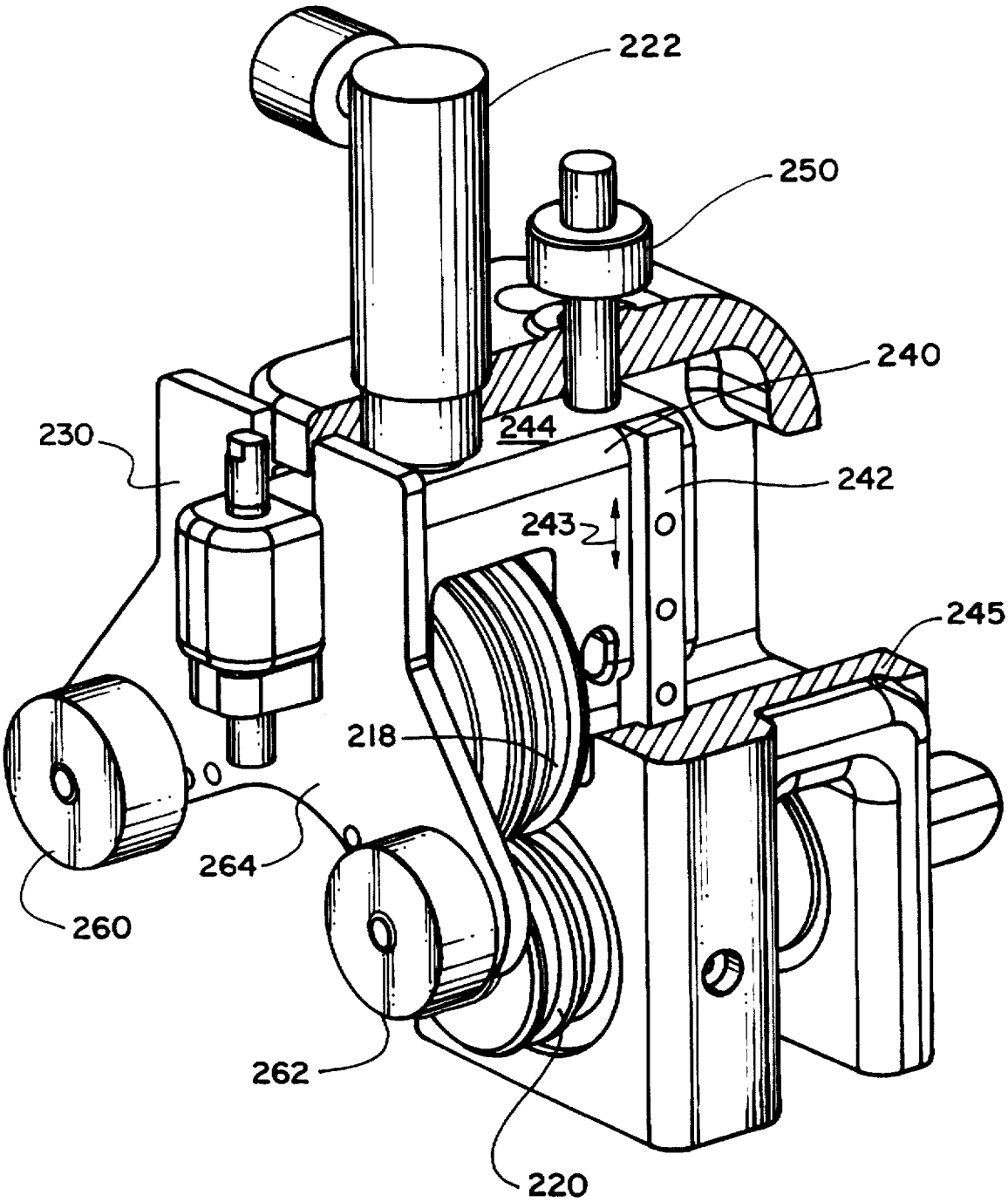
FIG. 10 shows an alternative embodiment of a rolling assembly.

Alternatively, referring to FIG. 10, instead of an outside groove roll 218 of a rolling assembly 212 being mounted to a pivot arm, outside groove roll 218 is mounted to a slide assembly 240 which slides on bars 242 (one bar being shown) along arrow 243 relative to a rolling assembly frame 245. A hydraulic ram 222 is lowered to contact a surface 244 of slide assembly 240 to lower outside groove roll 218 and positioning roller assembly 230. A depth stop 250 limits the depth to which slide assembly 240 can be lowered. The positioning rollers 260, 262 produce a differential load to offset the tube by mounting positioning rollers 260, 262 on face plate 264 with one of the positioning rollers lower than the other. Alternatively, positioning rollers 260, 262 can be mounted level on face plate 264 and offset to the side from the line of contact between outside and inside rollers 218, 220. Slide assembly 240 can be used with positioning roller assembly 30 to produce a groove in, e.g., steel tubing, and with positioning roller assembly 130 to produce an outward step in, e.g., copper tubing.

Other embodiments are within the following claims.

What is claimed is:

1. A positioning roller assembly for use when cold rolling a tube, the tube defining a longitudinal axis, comprising:

first and second positioning rollers located at set relative positions offset axially from an inner groove roll and an outer groove roll during cold rolling, said first and second positioning rollers being disposed for initial contact with a tube surface to apply a load upon the tube surface generally directed along a direction of load applied by the outer groove roll, and a mechanism for maintaining contact of said first and second positioning rollers relative to the tube surface during cold rolling.

2. The positioning roller assembly of claim 1 wherein said mechanism comprises a spring.

3. The positioning roller assembly of claim 2 wherein said spring comprises a stack of belleville washers.

4. The positioning roller assembly of claim 2 wherein said spring comprises a coiled helical spring.

5. The positioning roller assembly of claim 1 further comprising a face plate, said positioning rollers being mounted thereupon.

6. The positioning roller assembly of claim 5 wherein said face plate is mounted for movement with an outside groove roll.

7. The positioning roller assembly of claim 6 wherein said mechanism is adapted to move said face plate relative to the outside groove roll during cold rolling.

8. The positioning roller assembly of claim 1 wherein said first positioning roller is positioned to apply a first initial predetermined load to the tube and said second positioning roller is positioned to apply a second initial predetermined load to the tube less than said first initial predetermined load, said mechanism acting on the tube in a manner to equalize said first and second initial predetermined loads to offset the tube at a desired angle during cold rolling.

9. The positioning roller assembly of claim 1 further comprising an adjuster for adjusting the position of said positioning rollers prior to cold rolling.

10. The positioning roller assembly of claim 9 wherein said adjuster comprises an adjustment rod mounted for rotation relative to a carrier assembly to which an outside groove roll is fixedly mounted, said adjustment rod including a threaded section, said positioning roller being mounted to a face plate including a mating section defining a threaded hole for cooperative engagement with said rod threaded section, whereby rotation of said rod causes movement of said face plate relative to said carrier assembly for fine adjustment of said positioning rollers prior to cold rolling.

11. The positioning roller assembly of claim 10 wherein said rod is mounted for sliding movement relative to the carrier assembly.

12. The positioning roller assembly of claim 11 wherein said mechanism comprises a spring mounted to said rod and constrained between a shelf of said rod and the carrier assembly, whereby forces applied to said positioning rollers during cold rolling act to compress said spring.

13. The positioning roller assembly of claim 12 wherein said spring comprises a stack of belleville washers.

14. The positioning roller assembly of claim 10 further comprising a roller assembly frame, said carrier assembly being a pivot assembly mounted to pivot relative said roller assembly frame.

15. The positioning roller assembly of claim 10 further comprising a roller assembly frame, said carrier assembly being a slide assembly mounted to slide relative to said rolling assembly frame.

16. The positioning roller assembly of claim 1 further comprising a rod mounted to a carrier assembly to which an outside groove roll is fixedly mounted, said positioning rollers being mounted to a face plate including a mating section, wherein said mechanism comprises a spring mounted to said rod and constrained between said mating section and the carrier assembly whereby motion of said positioning rollers acts upon said spring.

17. A positioning roller assembly for use when cold rolling a tube, the tube defining a longitudinal axis, comprising:

first and second positioning rollers disposed for initial contact with a tube surface to apply a load upon the tube surface generally directed along a direction of load applied by an outer groove roll, a face plate for mounting of said first and second positioning rollers at set relative positions offset axially from the outer groove roll and an inner groove roll during cold rolling, said face plate being mounted for movement with an outside groove roll, a spring for positioning of said first and second positioning rollers during cold rolling, said spring providing for movement of said face plate relative to said outside groove roll during cold rolling, and a rod mounted to a carrier assembly to which the outside groove roll is fixedly mounted, said spring being mounted to said rod and constrained between said face plate and the carrier assembly whereby motion of said positioning rollers acts upon said spring.

18. A cold rolling machine for cold rolling a tube, the tube defining a longitudinal axis, comprising:

an outside groove roll, an inside groove roll, and a positioning roller assembly comprising:

first and second positioning rollers disposed for initial contact with a tube surface to apply a load upon the tube surface generally directed along a direction of load applied by the outside groove roll, a face plate for mounting of said positioning rollers at set relative positions offset axially from said groove rollers during cold rolling, said face plate being mounted for movement with said outside groove roll, and a mechanism for positioning of said positioning rollers during cold rolling, said mechanism providing for movement of said face plate relative to said outside groove roll during cold rolling.

19. A method of cold rolling a tube, the tube defining a longitudinal axis, comprising the steps of:

a. providing a cold rolling apparatus comprising an outside groove roll, an inside groove roll, and a positioning roller assembly comprising:

first and second positioning rollers disposed for initial rollers contact with a tube surface to apply a load upon the tube surface generally directed along a direction of load applied by the outside groove roll, a face plate for mounting of said first and second positioning rollers at set relative positions offset axially from said outside and inside groove rolls during cold rolling, said face plate being mounted for movement with said outside groove roll, and a mechanism for positioning of said positioning rollers during cold rolling, said mechanism providing for movement of said face plate relative to said outside groove roll during cold rolling.

b. positioning an end of a tube to be cold rolled between said outside and inside groove rolls, c. moving said outside groove roll and said positioning rollers into contact with an outside surface of said tube such that said tube is held between said outside groove roll and said inside groove roll, and d. further moving said outside groove roll toward said inside groove roll to cold roll said tube while said mechanism maintains contact of said positioning rollers with said tube during cold rolling.

* * * * *

UNITED STATES PATENT AND TRADEMARK OFFICE

CERTIFICATE OF CORRECTION

PATENT NO. : 5,778,715

DATED : July 14, 1998

INVENTOR(S) : Lippka et al.

It is certified that error appears in the above-identified patent and that said Letters Patent is hereby corrected as shown below:

Claim 20, should be added to read:

20. The positioning roller assembly of claim 8 wherein said first and second positioning rollers are positioned to apply a downward load to the tube during cold rolling.

Signed and Sealed this

Thirtieth Day of March, 1999

*Attest:*

Q. TODD DICKINSON

*Attesting Officer*

*Acting Commissioner of Patents and Trademarks*